US007532544B2

(12) United States Patent
Morse

(10) Patent No.: US 7,532,544 B2
(45) Date of Patent: May 12, 2009

(54) MULTIFUNCTION TIMER DEVICE

(76) Inventor: Kevin C. Morse, 5350 Kelly Rd., Flint, MI (US) 48504

( * ) Notice: Subject to any disclaimer, the term of this patent is extended or adjusted under 35 U.S.C. 154(b) by 0 days.

(21) Appl. No.: 11/803,272

(22) Filed: May 14, 2007

(65) Prior Publication Data

US 2008/0165623 A1 Jul. 10, 2008

Related U.S. Application Data

(62) Division of application No. 10/844,150, filed on May 12, 2004, now Pat. No. 7,236,428.

(51) Int. Cl.

| | |
|---|---|
| ***G04B 47/00*** | (2006.01) |
| ***G04B 19/24*** | (2006.01) |
| ***G04F 8/00*** | (2006.01) |
| ***G07F 11/00*** | (2006.01) |

(52) U.S. Cl. ..... 368/19; 368/29; 368/110; 221/2

(58) Field of Classification Search ..... 368/10, 368/28, 29, 107, 109, 110; 221/2, 3, 15
See application file for complete search history.

(56) References Cited

U.S. PATENT DOCUMENTS

| | | | | | |
|---|---|---|---|---|---|
| 4,419,016 | A * | 12/1983 | Zoltan | 368/10 |
| 4,504,153 | A * | 3/1985 | Schollmeyer et al. | 368/10 |
| 4,849,948 | A * | 7/1989 | Davis et al. | 368/10 |
| 4,855,971 | A * | 8/1989 | Meisner et al. | 368/188 |
| 4,939,705 | A * | 7/1990 | Hamilton et al. | 368/10 |
| 5,189,700 | A * | 2/1993 | Blandford | 713/178 |
| 5,233,571 | A * | 8/1993 | Wirtschafter | 368/10 |
| 5,751,660 | A * | 5/1998 | Chappell | 368/10 |
| 5,751,661 | A * | 5/1998 | Walters | 368/10 |
| 5,802,015 | A * | 9/1998 | Rothschild et al. | 368/10 |
| 5,953,288 | A * | 9/1999 | Chappell | 368/10 |
| 6,091,326 | A * | 7/2000 | Castellano | 340/457.4 |
| 6,263,438 | B1 * | 7/2001 | Walker et al. | 713/178 |
| 6,317,390 | B1 * | 11/2001 | Cardoza | 368/10 |
| 6,337,936 | B1 * | 1/2002 | Yoneyama | 385/24 |
| 6,355,907 | B1 * | 3/2002 | Kuehnle et al. | 219/121.7 |
| 6,390,327 | B1 * | 5/2002 | Cornell | 221/3 |
| 6,408,399 | B1 * | 6/2002 | Baughman | 714/4 |
| 6,527,462 | B2 * | 3/2003 | Arledge et al. | 400/103 |
| 6,529,446 | B1 * | 3/2003 | de la Huerga | 368/10 |
| 6,545,592 | B2 * | 4/2003 | Weiner | 368/10 |
| 6,604,650 | B2 * | 8/2003 | Sagar | 221/3 |
| 6,633,796 | B1 * | 10/2003 | Pool et al. | 700/231 |
| 6,667,936 | B1 * | 12/2003 | Ditzig | 368/10 |

(Continued)

*Primary Examiner*—Vit W Miska
(74) *Attorney, Agent, or Firm*—J. Gordon Lewis

(57) ABSTRACT

A multifunction timer device for providing a time/date stamp on objects includes a housing, a controller with a timer circuit contained in the housing, a display for displaying information from the timer circuit, and a multifunction input button. The input button is operable in predetermined sequences to select operating and display modes of the timer device. The input button can be operated to display an actual date or time, to display a current timer value, to select between count-up and count-down modes, and to increment a counter. An adhesive backing is provided for attaching the timer device to an object. A communications link is provided for interfacing the controller with an external programmer. A reset trigger is used to automatically reset the timer device when the object is moved in a particular way, such as when a lid is removed from a pill container.

16 Claims, 5 Drawing Sheets

U.S. PATENT DOCUMENTS 6,817,192 B2 * 11/2004 Ector et al. ..... 62/125
6,845,064 B2 * 1/2005 Hildebrandt ..... 368/10
2001/0036129 A1 * 11/2001 Carr ..... 368/109
2005/0128879 A1 * 6/2005 Sanford et al. ..... 368/109

* cited by examiner

MULTIFUNCTION TIMER DEVICE

RELATED APPLICATIONS

This application is a Divisional of an application entitled "Multifunction Timer Device", U.S. Ser. No. 10/844,150, filed 12 May 2004, now U.S. Pat. No. 7,236,428 B1, issued 26 Jun. 2007, and owned by the common inventor/applicant.

BACKGROUND OF THE INVENTION

1. Field of the Invention

The present invention relates generally to timer devices. In particular, the present invention relates to timer devices that can be attached to various objects and used to associate a particular time with the object.

2. Description of the Related Art

Many tasks in the home or in industry are time dependent. Food and pharmaceuticals are perishable. Equipment needs regular maintenance. With many of these time demands operating simultaneously (as they almost always do), it can be difficult to stay ahead of them and to prioritize those chores that need to be accomplished most urgently.

Some people use small, hand-written labels to mark the date that leftovers went into the freezer. Cars often carry small windshield tags reminding the driver of the next oil change date. Food carries "use by" dates. However, there remains a need for a multifunction device that consolidates all these applications and more using modern electronics to allow the device to be programmed for each particular application.

A variety of specific-use timer devices are known in the prior art for use with pharmaceuticals and pill containers. For example, U.S. Pat. No. 6,667,936 (Ditzig) shows a timer device that adheres to the top surface of a medicine bottle cap. The timer device includes an LCD and an electronic counting means that counts from 1 second up to 24 hours, at which time it flashes until reset. The device is automatically reset each time a user presses upon the top face (e.g., when opening the bottle).

U.S. Pat. No. 4,504,153 (Schollmeyer et al.) discloses a pharmacist-programmable timer device that can be built into or attached to a lid of a pill bottle. The device can be programmed (using an external programmer) to generate audible and visible prompting cues at intervals specified by the prescription instructions. The device is automatically reset in response to removal of the cap from the pill bottle or by use of a reset button.

U.S. Pat. No. 4,419,016 (Zoltan) discloses a timer device that can be attached to a cap of a pill container and reused with fresh containers. The device includes an LCD that identifies the time when the pill container was last opened and the elapsed time since the cap was last off. A "cap-on" sensor is used to reset each time the cap is taken off.

U.S. Pat. No. 6,317,390 (Cardoza), U.S. Pat. No. 5,751,661 (Walters), U.S. Pat. No. 6,545,592 (Weiner), U.S. Pat. No. 5,233,571 (Wirtschafter), and U.S. Pat. No. 4,939,705 (Hamilton et al.) each disclose a timer device built into the cap of a pill bottle. These timer devices have automatic resets that are activated when the cap is compressed or twisted.

SUMMARY OF THE INVENTION

An object of the present invention is to provide a multifunction timer device for associating particular tasks with particular times, which can be programmed simply and easily for use in a variety of applications.

Further objects of the present invention are to provide an inexpensive and reliable device for associating a time with an object; to provide a device that can be affixed to many different surfaces using an adhesive or other suitable means; and to provide a timer device that is compact in size while maintaining an easy to use interface.

It is a further object of the present invention to provide a timer device having a multifunction input button which is operable in predetermined sequences to change between a plurality of operating and display modes.

In order to accomplish these and other objects of the invention, a multifunction timer device is provided that includes a housing, a controller with a timer circuit contained in the housing, a display for displaying information from the timer circuit, and a multifunction input button. The input button is operable in predetermined sequences to select from among a plurality of operating and display modes of the timer device. The input button can be operated to display an actual date or time, a time of the last time/date of an action, to display a current timer value, to select between count-up and count-down modes, and to increment a counter. An adhesive backing is provided for attaching the timer device to an object. A communications link is provided for interfacing the controller with an external programmer. A reset trigger is used to reset the timer device when the object is moved in a particular way, such as when a lid is removed from a pill container.

According to a broad aspect of the present invention, a timer device is provided comprising a housing, a controller with a timer circuit contained in the housing, a display on the housing for displaying information from the timer circuit, and a multifunction input button. The input button is operable in a plurality of predetermined sequences to select from among a plurality of operating and display modes of the timer device.

According to another broad aspect of the present invention, a timer device for use with a container is provided, comprising: a housing adapted to be attached to a container; a controller with a timer circuit and a counter in the housing; a display on the housing for displaying information from the timer circuit; and a reset trigger having an adhesive strip for attaching the trigger to the container separate from the housing, whereby the counter of the timer circuit is automatically reset when the housing moves relative to the reset trigger upon opening the container.

According to another broad aspect of the present invention, a method of displaying a time date stamp on an object is provided, comprising the steps of: attaching a timer device to the object, the timer device including a timer circuit having a plurality of operating modes and a display for displaying information from the timer circuit; and operating a multifunction input button on the timer device according to a predetermined sequence to select one of the operating modes for the timer circuit.

Numerous other objects of the present invention will be apparent to those skilled in this art from the following description wherein there is shown and described preferred embodiments of the present invention, simply by way of illustration of some of the modes best suited to carry out the invention. As will be realized, the invention is capable of other different embodiments, and its several details are capable of modification in various obvious aspects without departing from the invention. Accordingly, the drawings and description should be regarded as illustrative in nature and not restrictive.

BRIEF DESCRIPTION OF THE DRAWINGS

The present invention will become more clearly appreciated as the disclosure of the invention is made with reference to the accompanying drawings. In the drawings.

DETAILED DESCRIPTION OF THE INVENTION

A multifunction timer device according to preferred embodiments of the present invention will now be described in detail with reference to FIGS. 1 to 7 of the accompanying drawings.

Figure 1:
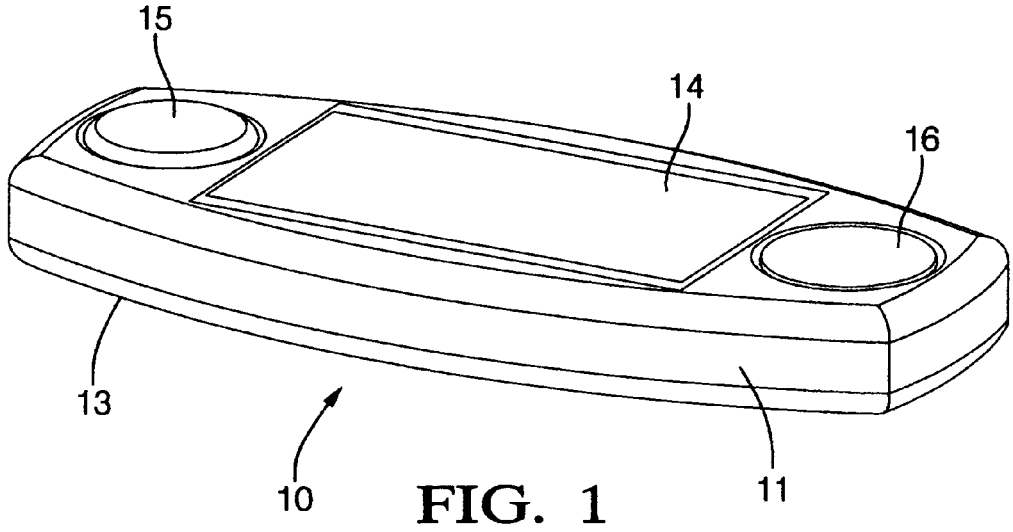
FIG. 1 is a perspective view of a multifunction timer device according to a first embodiment of the present invention.
Figure 2:
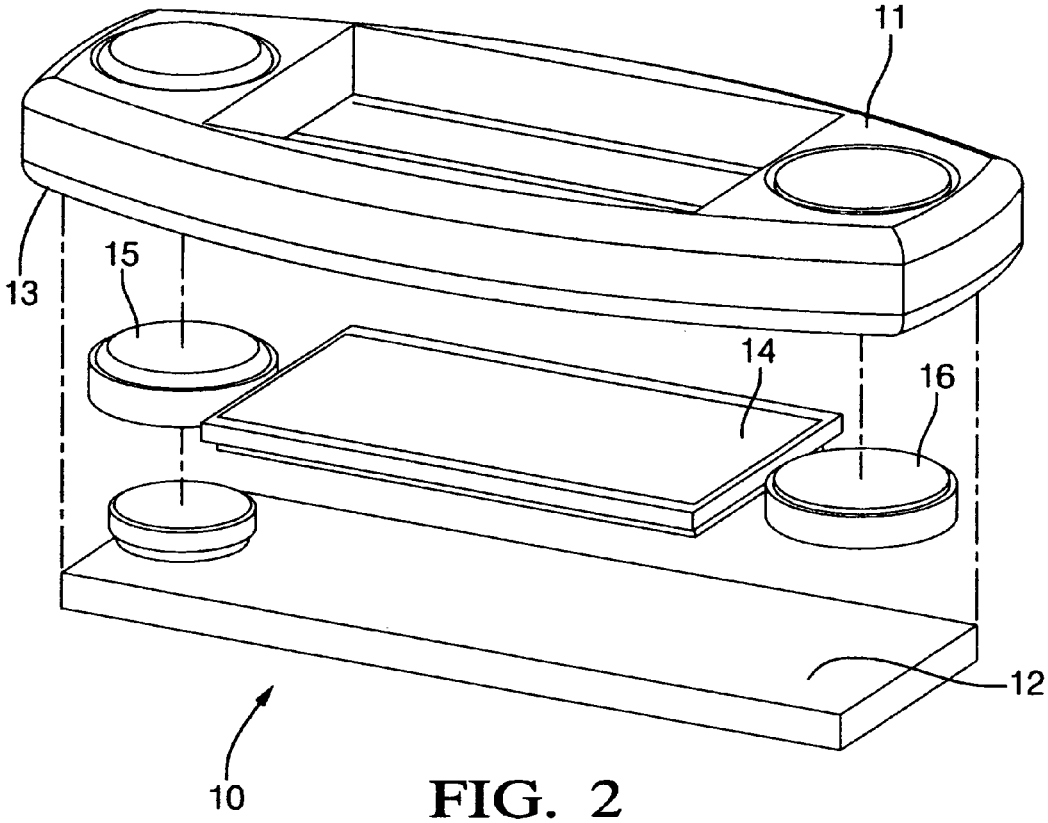
FIG. 2 is an exploded perspective view of the multifunction timer device shown in FIG. 1.

The multifunction timer device 10 according to a first embodiment of the present invention is shown in FIGS. 1 and 2 in assembled and disassembled conditions, respectively. The timer device 10 includes a housing 11 and various electronic components contained on a printed circuit board 12 contained within the housing 11. The housing 11 includes an adhesive strip 13 or other suitable fastening structure on a surface of its back side to secure the timer device 10 to an object, such as a food package, a pill container, a medical apparatus, or virtually any other object on which the user desires to associate a particular time with a particular task by fixing an electronic time/date stamp on the object.

The timer device 10 has a display interface 14 to display time information. The preferred display interface 14 is an LCD screen that allows precise time information to be conveyed to the user and is very compact and energy efficient. The timer information can be made to display only intermittently, and a backlit screen can be used to enhance viewing in low-light conditions. Other types of display interfaces include LED indicator lights, dials, and so forth.

Figure 5:
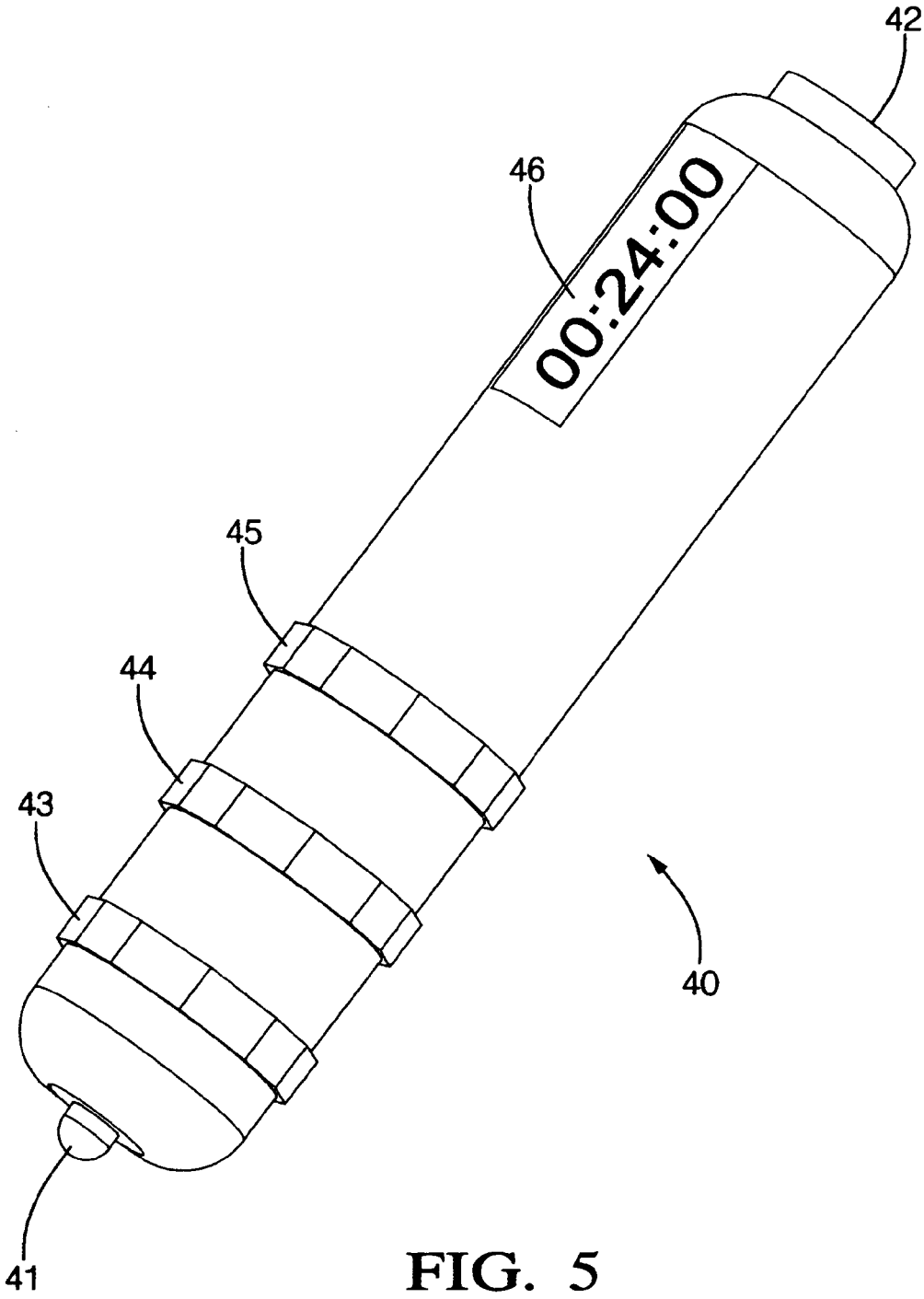
FIG. 5 is a perspective view of an external programmer used with the timer device of the present invention.

The timer device 10 also includes a multifunction input button 15 and a communications link 16, such as an infrared receiver, for interfacing with an external programmer 40 (shown in FIG. 5).

A timer device 20 according to a second embodiment of the invention will now be explained with reference to FIGS. 3 and 4 of the accompanying drawings. The timer device 20 is particularly suitable for attaching to the lid 21 of a pill container 22 or the like to provide an electronic time/date stamp for the pill container 22.

Figure 3:
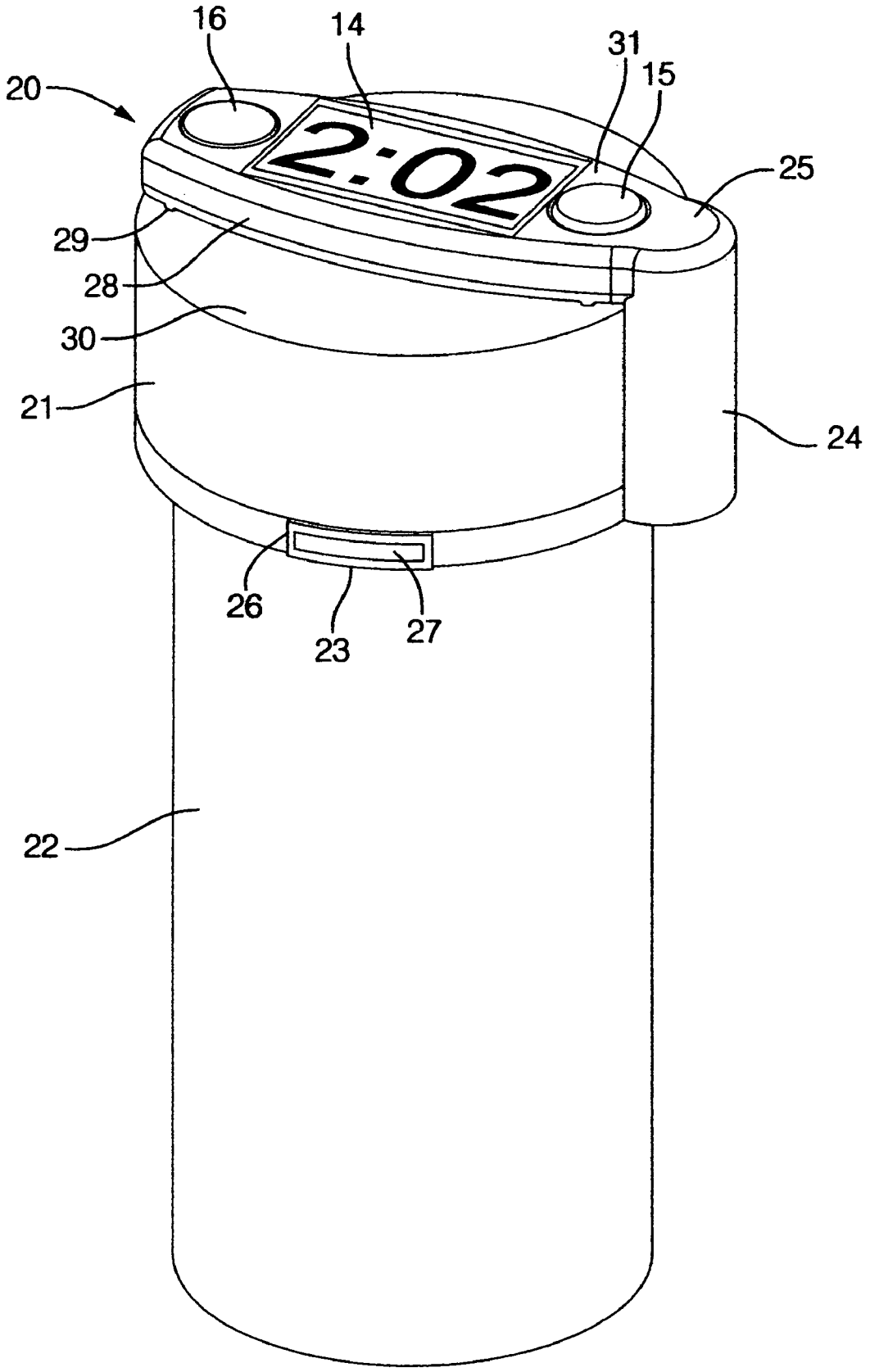
FIG. 3 is a perspective view of a timer device according to a second embodiment of the present invention attached to the lid of a pill container and having a reset trigger.
Figure 4:
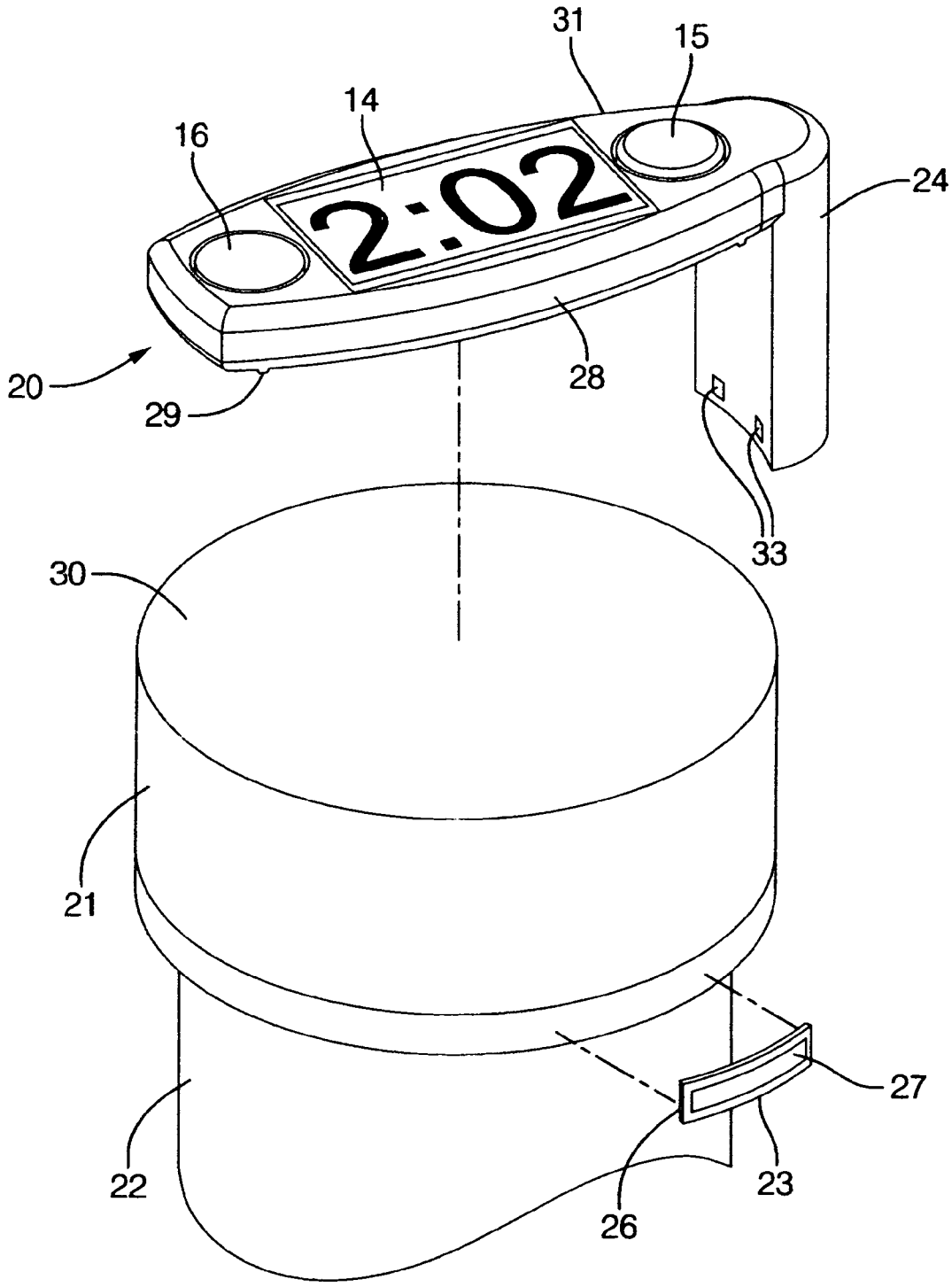
FIG. 4 is an exploded perspective view of the timer device, pill container, and reset trigger according to the second embodiment of the present invention.

The timer device 20 shown in FIGS. 3 and 4 includes many of the same basic features as the timer device 10 shown in FIGS. 1 and 2 and described above, and a further description of these same features will be omitted herein. The timer device 20 of the second embodiment differs from the timer device 10 of the first embodiment mainly in that it includes an automatic reset trigger 23 and an extended portion 24 of the housing 25 arranged to oppose the reset trigger 23.

The reset trigger 23 has an adhesive strip 26 or other suitable fastening means on its backside for attaching the trigger 23 to a sidewall of the container 22. The reset trigger has a conductive member 27 on its front side with a conductive surface facing outwardly from the container 22.

The housing 25 of the timer device 20 has a generally L-shaped configuration with a first leg 28 of the L shape corresponding generally to the housing 11 of the timer device 10 of the first embodiment. A first surface 29 on the backside of the first leg 28 is used for attaching the timer device 20 (e.g., using an adhesive) to a top surface 30 of the lid 21 of the container 22. The display interface 14 is arranged or exposed on a second surface 31 of the first leg 28 opposite to the first surface 29. The extended portion 24 of the housing 25 provides the second leg of the L shape and extends downwardly from the first leg 28 to oppose the sidewall of the container 22. A pair of electrical contacts 33 are mounted to the second leg 24 on a side facing the sidewall of the container 22.

In one example embodiment, the electronics of the timer device 20 of the second embodiment include a counter for monitoring the number and/or frequency of times pills are taken from the container 22 based on when the lid 21 is removed. In another example embodiment, the electronics of the timer device 20 include a timer circuit in which the timer is reset each time a pill is taken (i.e., each time the lid 21 is removed). The pair of electrical contacts 33 are connected to a reset pin of the timer circuit within the timer device 20 such that the counter is incremented or the timer circuit is reset each time the pair of contacts 33 are moved into (or out of) contact with the exposed outer surfaces of the conductive member 27 as the lid 21 is twisted on the container 22.

FIG. 5 shows an external programmer 40 that can be used to communicate with the timer devices 10, 20 to set the initial timer mode, to set a start time for a countdown mode, and to imprint the current date and/or time into the memory of the timer device 10, 20. In the preferred embodiment, the programmer 40 communicates with the timer device 10, 20 through an infrared link. Since only a few packets of information need to be transmitted from the programmer 40 to the timer device 10, 20, the programmer 40 can communicate on a very low bandwidth, which provides a relatively forgiving communication link. Pointing the infrared link of the programmer 40 in the general direction of the timer device 10, 20 from within a few feet should be sufficient.

The communication link of the programmer 40 in the preferred embodiment is an infrared LED 41. The infrared LED 41 is located at one end of the programmer 40, and a button 42 that initiates the transmission is located at the other end. Three rotatable wheels 43-45 are provided to select or adjust the mode, time increment and direction. To set the timer device to 24 hours, as shown in FIG. 5, one would set the first mode wheel 43 to the setting for the countdown mode. Then the time increment would be set to hours using the second wheel 44. The third wheel 45 would then be turned until the LCD screen 46 read 24:00. Of course, this is only one way the programmer 40 could function. Buttons instead of rotatable wheels could be used, for example, similar to a TV remote control.

Figure 6:
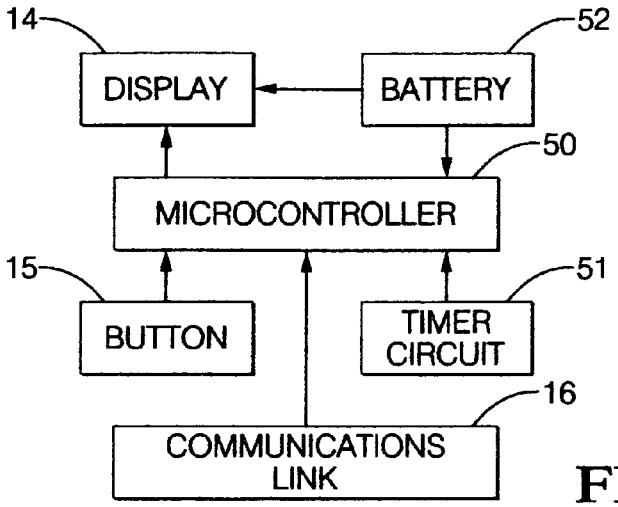
FIG. 6 is a block diagram showing the electrical components of the multifunction timer device.

The various electronic components contained on or connected to the printed circuit board 12 of the timer device 10, 20 will be explained with reference to FIG. 6. A programmable microcontroller 50 is provided on the printed circuit board 12 and arranged to receive timing information from a timer circuit 51. The microcontroller 50 outputs display signals to the display 14 for displaying timing information received from the timer circuit 51. A battery 52 is connected to the display 14 and to the microcontroller 50 for powering the device 10, 20. The microcontroller 50 receives operating and programming instructions from the multifunction input button 15 and from the external programmer 40 through the communications link 16.

The multifunction input button 15 is provided beside the display 14 in a convenient and intuitive location for operation by the user. The input button 15 is operable in a plurality of predetermined sequences to change the operating and display modes of the microcontroller 50 and/or the timer circuit 51. The predetermined sequences involve one or more presses of the input button 15 within a predetermined period of time. For example, a single press of the input button 15 will initiate a first control routine, two presses of the input button 15 within a short time period will initiate a second control routine, and three presses of the input button 15 within a short time period will initiate a third control routine.

A number of different circuit configurations can be used to produce a functioning timer device 10, 20. In the preferred embodiment, the printed circuit board 12 contains an oscillator that provides a very fast timing signal. This signal is then divided to provide pulses of more useful duration (e.g., seconds, minutes, hours).

A timer device 10, 20 is typically designed as either a count-up timer or a countdown timer. A count-up timer operates like a stopwatch and counts upward indefinitely. A countdown timer counts backwards from a preset start time. In the present invention, the timer device 10, 20 includes both a count up mode and a count down mode, which can be selected using the multifunction input button 15 to suit a particular application. If the timer device 10, 20 is set for counting up, the user can use the timer device 10, 20 for determining how long it had been since the timer had been activated. This function will be useful in situations where the useful life of an item is unknown, and qualitative decisions can be based on this time information. For example, two frozen dinners could be checked and the older one used first. For another example, one could tell at a glance how long it has been since the last pill was taken from a pill container.

In some applications, the count-up mode is not suitable or not best suited to associate a particular time to a particular task. For example, the count-up mode of the timer device 10, 20 does not give the user any frame of reference with which to judge the time information. The fact that an item (e.g., milk) has been on the shelf for a certain time period may not be sufficient information if the user does not know how long the item can be expected to last. In this case, the user may need a timer device having a countdown setting. The multifunction input button 15 of the present invention can be used to select the countdown mode for the timer device 10, 20 to suit these types of applications. In the countdown mode, the timer device 10, 20 has a predetermined end point (i.e., time zero). This makes it extremely useful for use with perishable goods and maintenance activities that must be performed at specific intervals.

Figure 7:
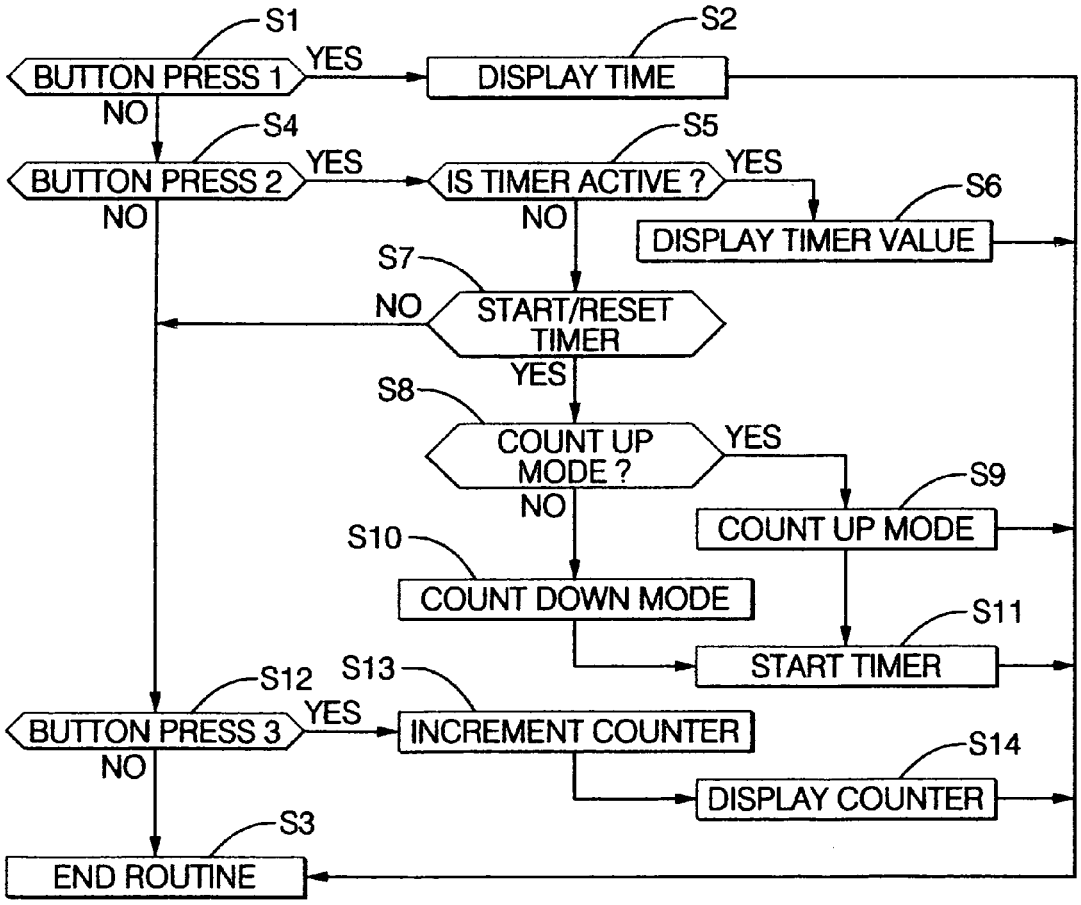
FIG. 7 is a flow chart showing the logic sequence used with the multifunction input button of the timer device.

FIG. 7 is a flow chart that illustrates some of the logic routines programmed into the microcontroller 50 in a preferred embodiment of the invention. The various logic routines are selectively activated by operating the multifunction input button 15 according to predetermined sequences, as explained above. A single press of the input button 15 is indicated at step S1 and causes the microcontroller 50 to awake from its power-conserving or "sleep" mode and to display a time/date on the display for a predetermined time period (e.g., 10 seconds) in step S2. The displayed time may be an actual or "real" time or a previously stored actual time, or an elapsed time since the button 15 was last pressed. It is understood that the type of time value displayed may be predetermined by the original programming of the microcontroller 50 or be determined by predetermined mode sequences. The control routine is then completed and passes to the end routine step S3 where the microcontroller 50 goes back into its sleep mode.

A double press of the input button 15 within a predetermined time period (e.g., 2 seconds) causes the control routine to go to step S4 and initiate a series of queries. The first query is to determine whether the timer is currently active, as indicated in step S5. That is, the microcontroller 50 will determine if the timer device 10, 20 is currently running in a timer mode. If the timer is currently active, the control routine will go to step S6 and display the timer value for a predetermined time period (e.g., 10 seconds). The control routine is then completed and passes to the end routine step S3 where the microcontroller 50 goes back into its sleep mode.

If the control routine determines in step S5 that the timer device 10, 20 is not currently active, the control routine will go to step S7 and display a message asking the user if he or she wants to start or reset the timer. If the user presses the input button 15 to indicate YES, the control routine will go to step S8. In step S8, the microcontroller 50 will display a message asking the user if he or she wants to set the timer circuit 51 in either a count-up mode, in which case the control routine goes to step S9, or a count-down mode, in which case the control routine goes to step S10. After the control routine sets the timer circuit 51 in the count-up mode or the count-down mode, the control routine goes to step S11 and the timer is started. The control routine is then completed and passes to the end routine step S3. If the user does not press the input button 15 for a predetermined time period (e.g., 10 seconds) in step S7, for example, the microcontroller 50 interprets this as a negative response and the control routine goes to step S12 or directly to the end routine step S3.

A triple press of the input button 15 within a predetermined time period (e.g., 3 seconds) causes the control routine to go to steps S12 and S13 to increment a counter contained on the printed circuit board 12. The counter information is then displayed on the display 14 in step S14. The control routine is then completed and passes to the end routine step S3 where the microcontroller 50 goes back into its sleep mode. This latter operating mode is useful for monitoring the taking of prescription pills by incrementing the counter when each pill is taken.

While the invention has been specifically described in connection with specific embodiments thereof, it is to be understood that this is by way of illustration and not of limitation, and the scope of the appended claims should be construed as broadly as the prior art will permit.

Having thus described the invention, what is claimed as new and desired to be secured by Letters Patent is as follows:

1. A timer device for use with a container, comprising:

a housing adapted to be attached to a container;

a controller with a timer circuit, a counter and a memory device contained in said housing;

a display interface on said housing for selectively displaying information from said timer circuit, counter and memory device;

a multifunction input button which is operable in a plurality of predetermined sequences to select from among a plurality of operating and display modes of the timer device, wherein said controller is operative to effect the display of the time of day or date of a previous actuation of said timer device in response to a first predetermined button actuation sequence, wherein said controller is further operative to effect a timer start/reset and to display a current timer value in response to a second predetermined button actuation sequence, and wherein said controller is further operative to increment/decrement a counter value and to display said counter value in response to a third predetermined button actuation sequence; and a reset trigger having a fastening means for attaching the trigger to the container separate from the housing, whereby at least one of the counter or the timer circuit is automatically incremented or reset when the housing moves relative to the reset trigger upon opening the container.

2. The timer device according to claim 1, wherein said timer circuit comprises a count-up mode and a count-down mode.

3. The timer device according to claim 2, wherein said multifunction input button is operable, in said second button actuation sequence, to toggle the timer circuit between said count-up mode and said count-down mode.

4. The timer device according to claim 1, wherein said predetermined sequences each comprise one or more presses of the multifunction input button within a predetermined amount of time.

5. The timer device according to claim 1, further comprising a means for attaching said housing to an object for providing an electronic time date stamp on the object.

6. The timer device according to claim 5, wherein said attaching means is an adhesive on a surface of said housing.

7. The timer device according to claim 1, wherein said display interface is a liquid crystal display.

8. The timer device according to claim 1, wherein said timer circuit is programmable to select a desired time increment.

9. The timer device according to claim 1, wherein said timer circuit is programmable to set a starting time or date.

10. The timer device according to claim 1, further comprising a communications link for interfacing the controller with an external programmer.

11. The timer device according to claim 1, further comprising a means for resetting or incrementing a counter when the object on which the housing is attached is moved in a predetermined way.

12. A method of displaying a time date stamp on a container, comprising the steps of:

attaching a timer device to the container, said timer device including a housing, a controller with a timer circuit, a counter and a memory device contained in said housing, a display interface on said housing for selectively displaying information from said timer circuit, counter and memory device, and a multifunction input button which is operable in a plurality of predetermined sequences to select from among a plurality of operating and display modes of the timer device, wherein said controller is operative to effect the display of the time of day or date of a previous actuation of said timer device in response to a first predetermined button actuation sequence, wherein said controller is further operative to effect a timer start/reset and to display a current timer value in response to a second predetermined button actuation sequence, and wherein said controller is further operative to increment/decrement a counter value and to display said counter value in response to a third predetermined button actuation sequence;

fastening a reset trigger to the container separate from the housing, whereby at least one of the counter or the timer circuit is automatically incremented or reset when the housing moves relative to the reset trigger upon opening the container; and operating said multifunction input button on said timer device according to one of said predetermined sequences to select one of said operating modes for said timer circuit.

13. The method according to claim 12, further comprising the step of operating the multifunction input button to increment/decrement the counter or start/reset the timer circuit.

14. The method according to claim 12, further comprising the step of using an external programming device to program said timer circuit to select at least one of an operating mode and a time increment.

15. The method according to claim 12, wherein said multifunction input button is operated, in said second button actuation sequence, to change the timer circuit between a count-up operating mode and a count-down operating mode.

16. The timer device according to claim 1, wherein the controller is operative to effect the simultaneous display of the time of day and the date of a previous actuation of said timer in response to said first button actuation sequence.

* * * * *